US005533571A

United States Patent [19]

Surjaatmadja et al.

[11] Patent Number: 5,533,571

[45] Date of Patent: Jul. 9, 1996

[54] SURFACE SWITCHABLE DOWN-JET/SIDE-JET APPARATUS

[75] Inventors: Jim B. Surjaatmadja, Duncan, Okla.; Kenneth D. Brune, Odessa, Tex.; Ken B. Kabinoff, Bakersfield, Calif.

[73] Assignee: Halliburton Company, Duncan, Okla.

[21] Appl. No.: 250,412

[22] Filed: May 27, 1994

[51] Int. Cl.[6] ..... E21B 21/00; E21B 34/14

[52] U.S. Cl. ..... 166/222; 166/318

[58] Field of Search ..... 166/222, 223, 166/318, 332, 317; 175/237, 331, 317

[56] References Cited

U.S. PATENT DOCUMENTS

| | | | |
|---|---|---|---|
| 1,279,333 | 9/1918 | Green | 166/222 |
| 2,828,107 | 3/1958 | Bobo | 175/237 X |
| 3,066,735 | 12/1962 | Zingg | 166/318 X |
| 3,116,800 | 1/1964 | Kammerer | 166/222 X |
| 3,145,776 | 8/1964 | Pittman | 166/55 |
| 3,795,282 | 3/1974 | Oliver | 175/237 X |
| 3,892,274 | 7/1975 | Dill | 166/222 |
| 3,958,641 | 5/1976 | Dill et al. | 166/312 |
| 4,346,761 | 8/1982 | Skinner et al. | 166/206 |
| 4,518,041 | 5/1985 | Zublin | 166/222 X |
| 4,625,799 | 12/1986 | McCormick et al. | 166/223 |
| 4,705,107 | 11/1987 | Council et al. | 166/170 |
| 4,744,420 | 5/1988 | Patterson et al. | 166/312 |
| 4,781,250 | 11/1988 | McCormick et al. | 166/240 |
| 4,818,197 | 4/1989 | Mueller | 418/48 |
| 4,967,841 | 11/1990 | Murray | 166/222 X |
| 5,029,644 | 7/1991 | Szarka et al. | 166/223 |
| 5,097,902 | 3/1992 | Clark | 166/187 |

OTHER PUBLICATIONS

Otis Engineering Corporation Brochure entitled "Break Down Buildups—And Restore Production With Hydra-Blast® Services" (1988).

Paper entitled "Principles of Hydraulic Jet Cleaning" dated Jul 2, 1987.

Catalog of Stoneage Waterjet Engineering (Undated but admitted to be prior art).

Halliburton Services Catalog Excerpt Section 6: Wellbore Cleanout (Jan., 1993).

Otis Engineering Corporation Products and Services Brochure (1989), p. 283.

*Primary Examiner*—Hoang C. Dang

*Attorney, Agent, or Firm*—Stephen R. Christian; Neal R. Kennedy

[57] ABSTRACT

A surface switchable down-jet/side-jet apparatus. The apparatus comprises a housing with a valve sleeve slidably disposed therein. When the valve sleeve is in a first position, fluid pumped into the apparatus will be jetted out of at least one longitudinally directed port. An actuator, such as a ball, is dropped into the apparatus to seat on the valve sleeve, and when pressure is applied thereto, forces the valve sleeve downwardly, shearing a shear pin. The valve sleeve is moved downwardly to a second position in which at least one transverse port in the housing is uncovered and the longitudinal port is closed. Additional fluid pumped into the apparatus is jetted radially outwardly through the transverse port.

6 Claims, 2 Drawing Sheets

SURFACE SWITCHABLE DOWN-JET/SIDE-JET APPARATUS

BACKGROUND OF THE INVENTION

1. Field of the Invention

This invention relates to hydraulic jet cleaning in wellbores, and more particularly, to a jetting tool which is switchable from a down-jet to a-side-jet configuration.

2. Description of the Prior Art

The buildup of materials on the inside of well casing or tubing is a common problem. It is known that many wells in some areas have buildup problems severe enough to eventually plug the tubing, and this problem may occur in both production and injection wells.

Common compounds causing such buildup problems are barium sulfate, silicates, calcium carbonate, calcium sulfate, carbonate, sulfate, silica, water scale with hydrocarbons, coke tar, coke and complexes, wax and complexes, paraffins, sludges, muds and gels.

Many different methods have been used to remove material buildup. For example, one method of dealing with paraffin buildup is to melt the paraffin with hot oil. Hot oil units heat crude oil, and the heated oil is circulated into the well. Hot water has also been used to melt and remove paraffin and also to remove salt. While in many cases this technique is successful, it does have the disadvantage of requiring considerable energy to heat the oil or water, and it is not useful in removing other materials which will not melt from the heat or which are not water soluble.

Chemicals may also be used to dissolve paraffin deposits. This may eliminate the problems of heating, but the chemicals may require special handling because they are usually highly flammable and toxic.

Other methods used to remove buildup include Dyna-Drills run on coiled tubing, milling with jointed tubing, acid washing, and broaching with a wireline.

To avoid the problems of removal of buildup by hot oil or water or by chemicals, jet cleaning was developed to utilize high pressure liquids to remove the materials by erosion. Coiled tubing service companies have performed jet cleaning jobs for many years. Generally, these jobs have been limited to removing mud cake, paraffin or packed sand. The jet cleaning tools of this type are usually made of heavy wall mechanical tubing with a plurality of holes of various diameters drilled in a symmetrical pattern around the tool. Water was used as the cleaning media. Job results were usually unpredictable, and it has been necessary on many occasions to change out the production tubing string. Accordingly, there is a need to efficiently and thoroughly clean material buildup in well casing or tubing.

The Otis Hydra-Blast® system was developed to address these problems by providing an economical means of cleaning buildup deposits from downhole tubing. This system utilizes high pressure fluid jet technology in conjunction with the economy and efficiency of coiled tubing. The Hydra-Blast® system includes an indexing jet cleaning tool, an in-line high pressure filter, a surface filter unit, a circulation pump with tanks and a coiled tubing unit. It also utilizes a computer program to design the actual cleaning jobs for any particular situation. The optimum jet size and number, retrieval speed and number of passes is calculated to accomplish a successful job, and this is particularly important in trying to remove harder materials such as the harder barium compounds. In general, this system may be described as a water blasting system which directs high pressure streams of water against the buildup to remove the material by the eroding or cutting action of moving fluid.

In a typical application of the Hydra-Blast® system, the operator uses a cleaning tool which at least in part utilizes a downward stream to cut into the material as the tool is lowered into the tubing. This is referred to as "down jetting" or "down blasting." In addition to downwardly directed jetting ports, there may be ports directed at any angle, including perpendicular to the longitudinal axis of the tool. This tool is particularly well adapted for cutting a path into any buildup which has closed off the tubing completely or which has reduced the diameter of the tubing such that the tool cannot enter the buildup area. However, the down-blast tool, even with side jetting ports is not particularly well adapted for removing large amounts of buildup along the walls after the tool is free to pass therein. The amount of fluid jetted to the side is not sufficient by itself to remove some deposits. In such cases, the original down-blast tool is removed from the well, and an additional well trip is made with a side-blast jetting head designed specifically for the purpose of providing jets directed against the buildup on the walls of the tubing. This two-step process works well, but the additional trip in and out of the well on the coiled tubing string is expensive. Additionally, in some cases, the first trip with a down-blast tool is not necessary at all, but this is generally not known until a down-blast tool is run into the tubing. Therefore, a need exists for a tool which can provide down blasting, but also can provide side blasting with only a single trip into the well.

The apparatus of the present invention solves this problem by providing a tool which allows down blasting as the tool is run into the tubing string and which may be switched to a side-blast tool without removal from the wellbore.

SUMMARY OF THE INVENTION

The present invention comprises a combination down-blast/side-blast tool, also called a down-jet/side-jet tool, for use in hydrablasting work. The use of this tool allows the operator to first start down blasting to initiate the hole in the material buildup in the tubing, after which the operator can switch the tool to a side-blast configuration by dropping an actuator, such as a ball. Thus, using this tool, no tripping is required to replace the down- blast jets with side-blast jets.

The apparatus of the present invention may be described as a fluid jetting apparatus for use in a well which comprises housing means for attaching to a tool string, wherein the housing means defines a central opening therein and a substantially longitudinal port and a substantially transverse port, valve means disposed in the housing means for covering the transverse port when in a first position such that fluid pumped into the central opening of the housing means is directed through the longitudinal port and for placing the transverse port into communication with the central opening when in a second position, and actuation means for actuating the valve means from the first position to the second position thereof and closing the longitudinal port such that fluid pumped into the central opening of the housing means is directed through the transverse port. The apparatus further comprises shear means for shearably holding the valve means in the first position and which is sheared when the valve is actuated and moved to the second position.

In the preferred embodiment, the valve means is characterized by a valve sleeve slidably disposed in the central opening of the housing means. The valve sleeve has a seating surface thereon, and the actuation means is preferably characterized by an actuating device, such as a ball, adapted for sealing engagement with the seating surface. In one embodiment, the valve means comprises means for retaining the ball after engagement thereof with the seating surface.

A sealing means is provided for sealing between the valve means and the housing means, and when the valve means is in the first position, the sealing means is adapted for sealing on opposite sides of the transverse port.

The apparatus may further comprise a means for limiting movement of the valve means, which is characterized in the preferred embodiment by a shoulder or corner in the housing means which is contacted by the valve sleeve when it reaches the second position.

Numerous objects and advantages of the invention will become apparent when the following detailed description of the preferred embodiments is read in conjunction with the drawings which illustrate such embodiments.

DESCRIPTION OF THE PREFERRED EMBODIMENTS

Figure 1A:
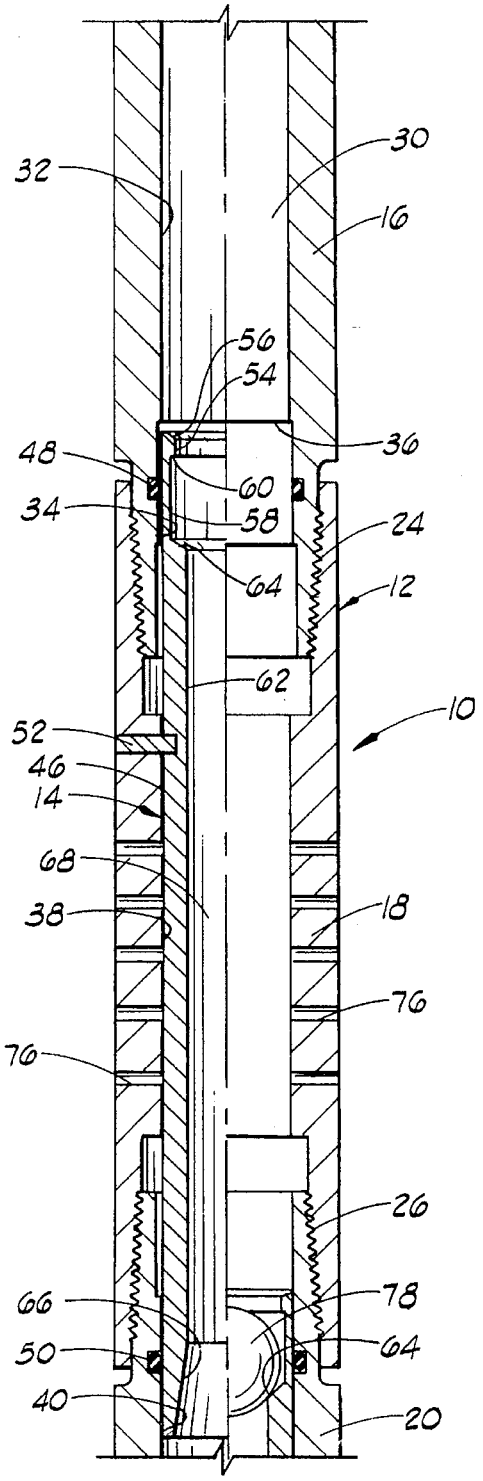
FIGS. 1A and 1B show a longitudinal cross section of a preferred embodiment of the switchable down-jet/side-jet apparatus of the present invention.
Figure 1B:
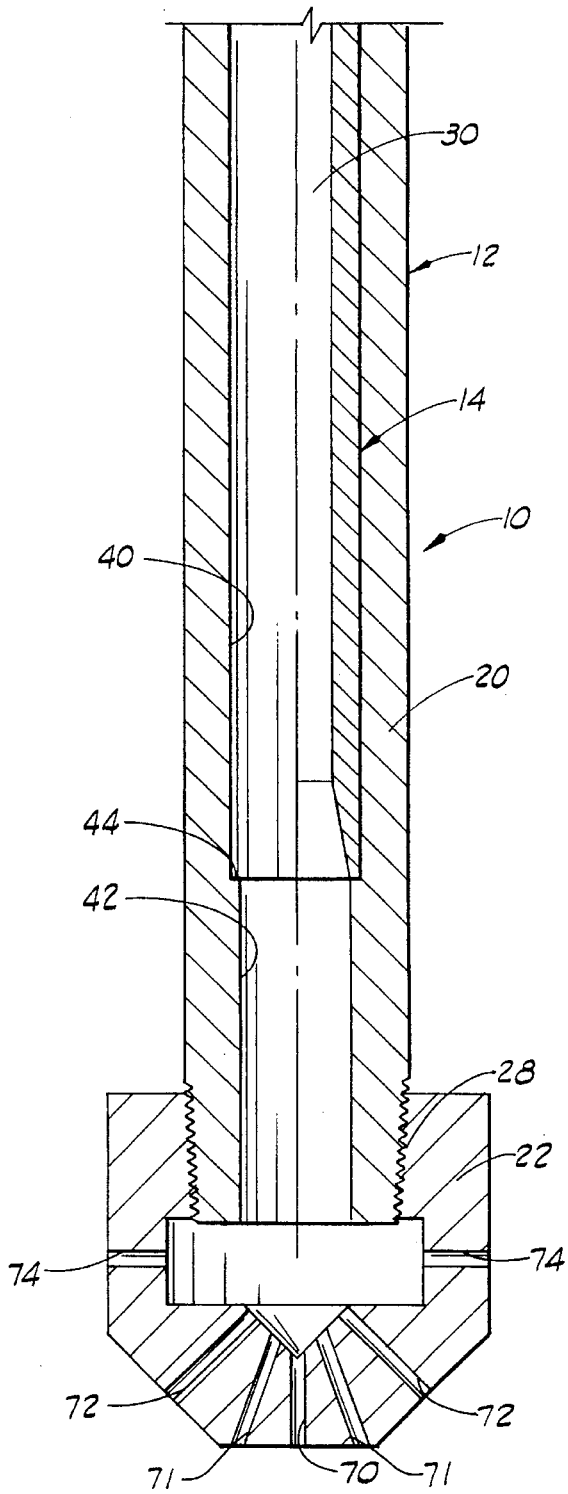

Referring now to the drawings, and more particularly to FIGS. 1A and 1B, a first embodiment of the down-jet/side-jet (or down-blast/side-blast) jetting apparatus of the present invention is shown and generally designated by the numeral 10. Generally, apparatus 10 comprises a housing means 12 attachable to a tool or tubing string with a valve means 14 slidably disposed in the housing means. The left sides of FIGS. 1A and 1B show valve means 14 in a first position, and the right side of FIGS. 1A and 1B show valve means 14 in a second position.

In this first embodiment, housing means 12 is generally characterized as an elongated housing 12 including an upper adapter 16, a side-blast housing 18, a lower adapter 20 and an down-blast cap 22. Upper adapter 16 is connected to the upper end of side-blast housing 18 at threaded connection 24. Similarly the lower end of side-blast housing 18 is connected to the upper portion of lower adapter 20 at threaded connection 26, and the lower portion of lower adapter 20 is attached to down-blast cap 22 at threaded connection 28. Housing means 12 generally defines a longitudinally extending central opening 30 therein which is terminated at its lower end by down-blast cap 22.

Upper adapter 16 defines a first bore 32 therein with a slightly larger second bore 34 therebelow. A downwardly facing shoulder 36 is defined between first bore 32 and second bore 34. Side-blast housing 18 defines a bore 38 therein which is slightly larger than second bore 34 in upper adapter 16. Lower adapter 20 has a first bore 40 therein with a slightly smaller second bore 42 therebelow. First bore 40 is substantially the same size as bore 38 in side-blast housing 18. An upwardly facing annular shoulder 44 is defined between first bore 40 and second bore 42 in lower adapter 20.

Referring now to FIG. 1A, valve means 14 is characterized by an elongated valve sleeve 14 having an outside diameter 46. The upper end of valve sleeve 14 fits closely, but slidably, within second bore 34 of upper adapter 16, bore 38 of side-blast housing 18 and first bore 40 of lower adapter 20. A sealing means, such as an 0-ring 48, provides sealing engagement between upper adapter 16 and the upper portion of valve sleeve 14 when the valve sleeve is in the first position shown in the left side of FIG. 1A. Similarly, another sealing means, such as an O-ring 50, provides sealing engagement between the lower portion of valve sleeve 14 and lower adapter 20. Valve sleeve 14 is initially held in the first position shown in the left side of FIG. 1A by a shear means, such as a shear pin 52.

Valve sleeve 14 has a first bore 54 with an upwardly facing chamfer 56 at the upper end thereof. Valve sleeve 14 also defines a larger second bore 58 therein, and a downwardly facing shoulder 60 extends between first bore 54 and second bore 58. Below second bore 58 is a smaller third bore 62, and at the upper end of the third bore is an upwardly facing chamfered seat 64. At the lower end of valve sleeve 14 is a tapered inner surface 66 which tapers outwardly and downwardly from third bore 62.

Valve sleeve 14 defines a central opening 68 extending therethrough which is in communication with central opening 30 of housing means 12.

Referring to FIG. 1B, down-blast cap 22 defines a plurality of jetting ports therein, and in the illustrated embodiment, these jetting ports include a longitudinally extending port 70, angularly disposed ports 71 and 72, and transversely disposed ports 74. The actual number and direction of the ports may be varied as desired. In fact, all may be eliminated except that one at least partially longitudinally disposed port is included. "Longitudinal port" as used herein can include any port extending at least partially in a longitudinal direction. It is not intended that the invention be limited to a purely longitudinal port such as port 70. Ports 71 and 72, for example, extend partially in a longitudinal direction. Port 70 may also be referred to as a downwardly directed port 70. Ports 71 and 72 extend partially downwardly.

Figure 2:
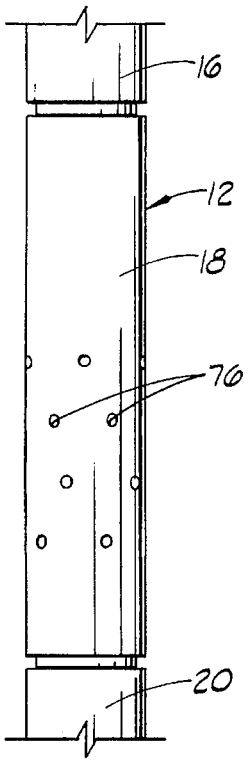
FIG. 2 is a side elevation of a portion of the jetting apparatus showing one pattern of transversely disposed jetting ports.
Figure 3:
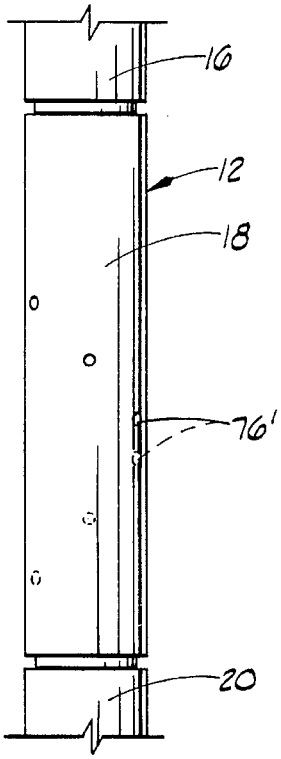
FIG. 3 is a side elevational view of the jetting apparatus showing transverse jetting ports in a spiral pattern around the housing.

When ready for operation, side-blast housing 18 defines a plurality of transversely extending ports 76 therethrough. In one preferred embodiment, housing 18 has no ports therein when initially manufactured. When apparatus 10 is ready to be used in the field, side-blast housing 18 may be drilled to provide the desired number and pattern of ports 76, depending on well conditions. For example, in FIG. 2, ports 76 are shown in generally evenly spaced rows. In FIG. 3, another arrangement of ports 76' are shown disposed in a spiral pattern around side-blast housing 18. It should be understood that the invention is not intended to be limited to any particular pattern or number of ports 76, 76'.

It will be seen that valve sleeve 14 covers ports 76, 76' and O-rings 48 and 50 seal on opposite sides of ports 76, 76' when the valve sleeve is in its first position.

Figure 4:
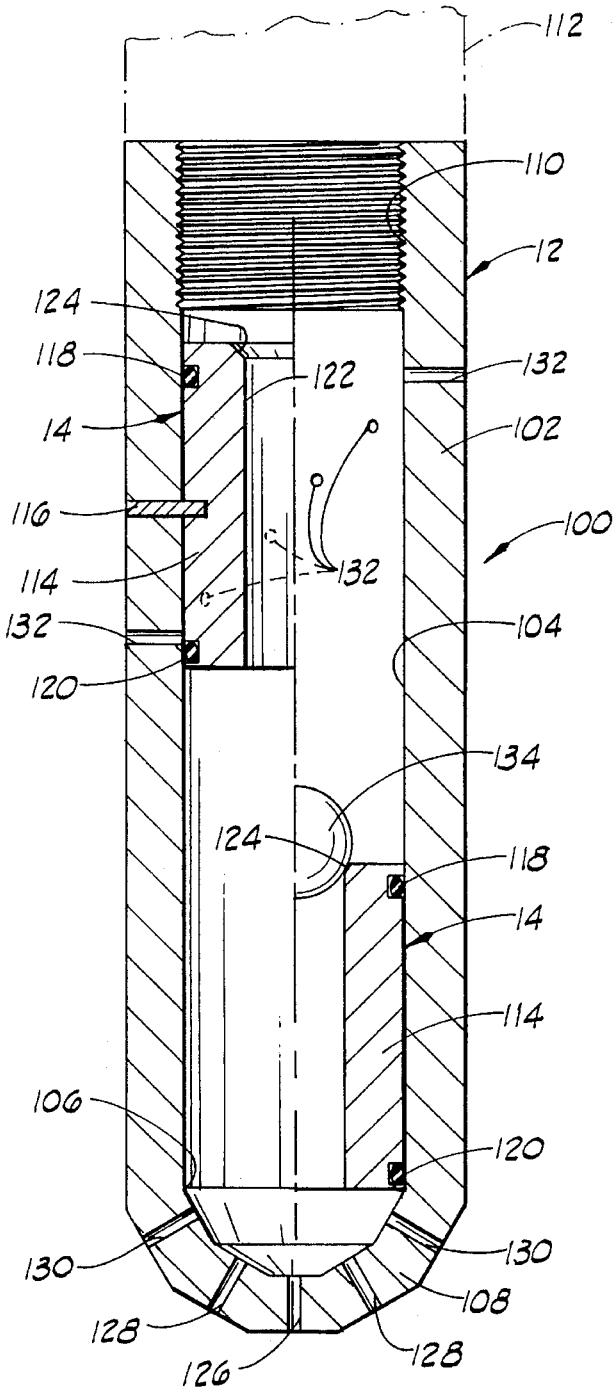
FIG. 4 shows an alternate embodiment of the jetting apparatus of the present invention.

Referring now to FIG. 4, a second embodiment of the down-blast/side-blast jetting apparatus of the present invention is shown and generally designated by the numeral 100. As with the first embodiment, second embodiment 100 generally comprises a housing means 12 with a valve means 14 slidably disposed therein.

In alternate embodiment 100, housing means 12 is generally characterized by a one-piece housing 102 having a bore 104 therein with a shoulder 106 at the lower end thereof. Shoulder 106 may also be referred to as a corner 106. It will be seen that bore 104 may also be described as a central opening 104 in second embodiment 100. Shoulder 106 is formed by a lower end 108 of housing 102. At the upper end of housing 102 is an internally threaded surface 110 adapted for engagement with a tubing string 112 of a kind known in the art.

In alternate embodiment 100, valve means 14 is characterized by a valve sleeve 114 which is slidably disposed in bore 104 of housing 102. In the first position of valve sleeve 114 shown on the left side of FIG. 4, the valve sleeve is initially held in place by a shear means, such as a shear pin 116.

A sealing means, such as O-ring 118, provides sealing engagement between the upper end of valve sleeve 114 and bore 104 of housing 102. Similarly, another sealing means, such as O-ring 120 provides sealing engagement between the lower end of valve sleeve 114 and bore 104.

Valve sleeve 114 defines a bore 122 therethrough with an upwardly facing chamfered seat 124 at the upper end of bore 122.

Lower end 108 of housing 102 defines a plurality of jetting ports therethrough, such as a longitudinally disposed or downwardly directed port 126, and various angled ports 128 and 130. As with first embodiment 10, alternate embodiment 100 is not intended to be limited to the particular configuration, angle or number of ports 126, 128 and 130, except that at least one downwardly directed port 126 is included. The exact number and arrangement of the jetting ports formed in lower end 108 of housing 102 may be varied as desired.

Housing 102 also defines a plurality of transversely extending ports 132 therein. In the illustrated embodiment, ports 102 are shown in a spiral pattern around housing 102, but the exact arrangement and number of ports 132 may be varied, just as in first embodiment 10 previously described.

It will be seen that valve sleeve 114 covers ports 132 and O-rings 118 and 120 seal on opposite sides of ports 132 when the valve sleeve is in its first position.

OPERATION OF THE INVENTION

Referring to FIGS. 1A and 1B, the operation of first embodiment jetting apparatus 10 will be described. The apparatus is run into the well with valve sleeve 14 in the first position shown in the left side of FIGS. 1A and 1B. As apparatus 10 is lowered into the wellbore, fluid may be pumped into central opening 30 of housing means 12, thus also through central opening 68 of valve sleeve 14, so that the fluid is jetted out of ports 70, 72 and 74. This use of the tool allows the operator to first start down blasting to initiate the hole in the material to be blasted in a manner similar to the Otis Hydra-Blast® system, assuming that this step is necessary at all.

Once the initial down blasting, if any, is completed, apparatus 10 may be converted to a side-blast apparatus by dropping an actuating device, such as ball 78 into the tubing string so that it falls toward apparatus 10. Ball 78 is preferably of a kind known in the art having an elastomeric coating over a metal or plastic center. One such ball is the Halliburton Perf Pac ball, although other types of balls may also be used. Ball 78 first engages chamfer 56 at the upper end of valve sleeve 14, but slight pressure on ball 78 will cause it to pass through first bore 54 of valve sleeve 14 because of the flexibility of the elastomeric outer coating on the ball. Ball 78 will then engage seat 64 in valve sleeve 14 and will substantially sealingly close central opening 30 in housing means 12 by blocking central opening 68 of the valve sleeve. This closes ports 76, 72 and 74.

Pressure applied in the tubing string exerts a downward force on ball 78, shearing shear pin 52 and moving valve sleeve 14 to its second position shown in the right side of FIGS. 1A and 1B. The downward movement of valve sleeve 14 is limited by its engagement with shoulder 44, and thus, a means is provided for limiting movement of the valve means. In the second position, sealing engagement is provided between the upper portion of valve sleeve 14 and lower adapter 20 by O-ring 50. It will also be seen that when valve sleeve 14 is in the second position, transverse jetting ports 76 or 76' are uncovered and placed in communication with central opening 30 of housing means 12. Additional pressure applied will result in radially outwardly directed jetting of the fluid through ports 76 or 76' to remove the material in the wellbore.

Ball 78 is prevented from moving upwardly by shoulder 60 in valve sleeve 14. That is, there is not usually sufficient upwardly acting pressure in the tool to force ball 78 back upwardly past first bore 54 in valve sleeve 14. Thus, it may be said that a retaining means is provided for retaining the ball after engagement thereof with seat 64.

The operation of alternate embodiment 100 is similar to that of the first embodiment. A ball-retaining means is not shown in FIG. 4, but such a retaining means could be incorporated into valve sleeve 114. A ball 134 is dropped into the tubing string so that it falls toward apparatus 100. Eventually, ball 134 engages seat 124 on valve sleeve 114 so that pressure applied thereto will shear pin 116 and move valve sleeve 114 downwardly to the second positions shown in the right side of FIG. 4. Downward movement of valve sleeve 114 is limited by engagement thereof with shoulder 106 in housing 102.

Once valve sleeve 114 is moved to the second position, transverse jetting ports 132 are uncovered and placed in communication with central opening 104 of housing 102 so that the fluid is jetted radially outwardly through ports 132, just as in the first embodiment.

First embodiment apparatus 10 is generally designed for situations where the tool is relatively large. In this way, as ports 70, 72, 74 and 76 or 76' are gradually eroded by the jetting fluid, only side-blast housing 18 and down-blast cap 22 need to be replaced when refitting the tool. The second embodiment 100 is generally designed for situations where the tool is smaller so that the entire housing 102 may be discarded. In spite of this, however, it is not intended that the invention be limited to any particular configuration regardless of its size or the size of the tubing or casing intended to be cleaned. That is, the first embodiment 10 configuration could be manufactured to fit small bore situations, and the alternate embodiment 100 configuration could be used in large bore situations.

It will be seen, therefore, that the down-blast/side-blast jetting apparatus of the present invention is well adapted to carry out the ends and advantages mentioned, as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A fluid jetting apparatus for use in a well, said apparatus comprising:

housing means for attaching to a tubing string, said housing means defining a central opening, a substantially longitudinal port and a substantially transverse port therein;

valve means disposed in said housing means for covering said transverse port when in a first position, such that fluid pumped into said central opening of said housing means is directed through said longitudinal port, and for placing said transverse port in communication with said central opening when in a second position, said valve means being characterized by a valve sleeve slidably disposed in said central opening of said housing means and said valve sleeve having a seating surface thereon; and actuation means for actuating said valve means from said first position to said second position and closing said longitudinal port such that fluid pumped into said central opening of said housing means is directed through said transverse port, said actuation means being characterized by a ball adapted for sealing engagement with said seating surface on said valve sleeve;

wherein, said valve sleeve further comprises means for retaining said ball after engagement thereof with said seating surface.

2. The apparatus of claim 1 wherein said housing means comprises a plurality of transverse jetting ports disposed in a spiral pattern around said housing means.

3. A fluid jetting apparatus for use in a well, said apparatus comprising:

an elongated housing adapted for attachment to a tubing string, said housing defining a central opening therethrough and further defining a substantially longitudinal port and a substantially transverse port therein;

a valve sleeve slidably disposed in said housing for covering said transverse port when in a first position such that fluid pumped into said central opening of said housing is directed through said longitudinal port and for placing said transverse port in communication with said central opening when in a second position, said valve sleeve having a substantially chamfered seating surface thereon;

an actuator adapted for engaging said valve sleeve and moving said valve sleeve from said first position to said second position in response to a fluid pressure in said central opening, thereby closing said longitudinal port such that fluid pumped into said central opening of said housing is directed through said transverse port, said actuator being a ball adapted for sealing engagement with said seating surface on said valve sleeve; and retaining means for retaining said ball and preventing substantial upward movement thereof after engagement of said ball with said seating surface.

4. The apparatus of claim 3 wherein said housing defines a plurality of transverse jetting ports arranged in a spiral pattern.

5. A fluid jetting apparatus for use in removing material buildup in well casing and tubing, said apparatus comprising:

an elongated one-piece housing adapted for attachment to a tubing string, said housing defining a substantially longitudinal jetting port and a substantially transverse jetting port therein;

a valve sleeve slidably disposed in said housing for sealingly covering said transverse jetting port when in a first position such that fluid pumped into said central opening of said housing is directed through said longitudinal jetting port and for placing said transverse jetting port in communication with said central opening when in a second position; and an actuator adapted for engaging said valve sleeve and moving said valve sleeve from said first position to said second position in response to a fluid pressure in said central opening, thereby closing said longitudinal jetting port such that fluid pumped into said central opening of said housing is directed only through said transverse jetting port.

6. The apparatus of claim 5 wherein said housing means comprises a plurality of transverse jetting ports disposed in a spiral pattern around said housing.

* * * * *